US005350090A

United States Patent [19]

McClure

[11] Patent Number: 5,350,090

[45] Date of Patent: Sep. 27, 1994

[54] BEVERAGE DISPENSER

[76] Inventor: Ralph K. McClure, 6589 Leffingwell Rd., Canfield, Ohio 44406

[21] Appl. No.: 60,314

[22] Filed: May 11, 1993

[51] Int. Cl.[5] ..... B67D 3/02

[52] U.S. Cl. ..... 222/511; 251/245; 251/357; 277/106; 222/402.25

[58] Field of Search ..... 251/357, 245, 244; 222/402.25, 518, 394, 511; 277/188 A, 106, 178

[56] References Cited

U.S. PATENT DOCUMENTS

| | | | |
|---|---|---|---|
| 361,400 | 4/1887 | Quillfeldt | 251/244 |
| 597,834 | 1/1898 | Shortle | 251/245 |
| 617,655 | 1/1899 | Ormerod | 251/245 |
| 2,372,392 | 3/1945 | Pletman | 222/402.25 |
| 2,530,583 | 11/1950 | Nurkiewicz | 222/402.25 |
| 2,570,422 | 10/1951 | Bashore | 222/518 |
| 2,673,570 | 3/1954 | Cunningham et al. | 251/357 |
| 2,685,978 | 8/1954 | Crockett | 222/511 |
| 2,779,518 | 1/1957 | Morris | 222/518 |
| 2,830,745 | 4/1958 | Aicart | 222/402.25 |
| 3,998,364 | 12/1976 | Hollander | 222/511 |
| 4,194,653 | 3/1980 | Brown | 222/402.25 |
| 4,671,436 | 6/1987 | Hagan | 222/402.25 |
| 4,715,516 | 12/1987 | Salvail | 222/402.25 |
| 4,773,571 | 9/1988 | Hagan et al. | 222/394 |
| 4,860,932 | 8/1989 | Nagy | 222/402.1 |
| 4,887,744 | 12/1989 | Williams | 222/402.1 |
| 4,995,534 | 2/1991 | Norman | 222/464 |

*Primary Examiner*—Andres Kashnikow
*Assistant Examiner*—Christopher G. Trainor
*Attorney, Agent, or Firm*—Watts Hoffmann Fisher & Heinke

[57] ABSTRACT

A dispenser for use with a pressurizable fluid container. The dispenser comprises a head removably connectable with the container. The head includes an inlet, an outlet, a valve seat, a cavity and a chamber for fluid communication between the inlet and outlet. The valve seat is located between the inlet and the chamber. The cavity is located between the inlet and the valve seat. A valve body has a portion locatable in the chamber. The valve body is actuatable for movement between an open position allowing fluid flow through the chamber and a closed position blocking fluid flow through the chamber. The valve body includes a seal seat surface adapted to face in a direction towards the inlet when the valve body is within the chamber. A seal is receivable on the valve body for engagement with the seal seat surface. The seal is engageable with the valve seat to define the closed position. A cap member is engageable with a surfaced defining the cavity in the head to fixedly attach the cap member within the cavity. A bias mechanism is engageable with the cap member for normally biasing the seal towards the valve seat.

18 Claims, 4 Drawing Sheets

BEVERAGE DISPENSER

BACKGROUND OF THE INVENTION

1. Technical Field

The present invention relates generally to a liquid dispensing apparatus which is connectable with a container. In particular, the present invention relates to a beverage dispensing apparatus sealingly connectable with a bottle, such as is used for storing a carbonated soft drink, and relates to a seal structure used in the dispensing apparatus.

2. Description of the Prior Art

Dispensing a liquid, such as a carbonated beverage drink, from a container is typically accomplished by manipulating the uncapped container so a dispensing neck is lower than the liquid level. The liquid is then free to exit through an opening in the neck of the container. The container needs to be recapped properly to store the liquid so that carbonation of the beverage is not lost If the container is not properly recapped, or remains uncapped for even a relatively short time, the carbonation could be lost by escaping to the atmosphere and the drink becomes "flat".

The containers are becoming larger and at times difficult to handle because of their relatively large size and weight when filled. The containers are especially difficult to handle if the container has relatively smooth exterior surface. Dispensers, which permit a carbonated beverage bottle to remain upright during dispensing, have been developed in order to overcome the disadvantages associated with manipulating and dispensing a liquid drink from a container, such as the one described above.

A household, business or the like may typically have more than one bottle of a carbonated beverage opened at any one time. The household, business or the like will, therefore, require more than one dispensing apparatus in order to accommodate all of the opened bottles. Thus, a relatively inexpensive and easy to assemble dispenser is needed. However, it is also equally important that the dispenser be effective to seal the beverage container for a relatively long period of time, for example, a week or month, in which the carbonation of the beverage drink is not diminished to any significant degree.

SUMMARY OF THE INVENTION

The present invention is directed to a liquid dispenser that is relatively inexpensive, easy to assemble and is capable of sealing a beverage container for a relatively long period of time in which a relatively large proportion of the carbonation in the beverage is retained. The dispenser of the present invention accomplishes this difficult task by providing a novel single seal capable of sealing at two locations in the dispenser. Thus, the dispenser of the present invention has significant advantages over prior beverage dispensers.

The present invention is directed to a beverage dispenser which is suitable for use with a pressurizable fluid container. The dispenser includes a head removably connectable with the container. The head includes an inlet, an outlet, a valve seat, a cavity and a chamber for fluid communication between the inlet and outlet. The valve seat is located between the inlet and the chamber. The cavity is located between the inlet and the valve seat. A valve body has a portion receivable in the chamber. The valve body is actuatable for movement between an open position allowing fluid flow through the chamber and a closed position blocking fluid flow through the chamber. The valve body includes a seal seat surface adapted to face in a direction towards the inlet when the valve body is properly installed within the chamber. A seal is receivable on the valve body for engagement with the seal seat surface. The seal is also for engagement with the valve seat in the head to establish the closed position. A cap member is engageable with a surface defining the cavity in the head to fixedly attach the cap member within the cavity. Bias means is engageable with the cap member for normally biasing the valve body towards the closed position.

The seal includes a first axial end portion having a first outer diameter. The seal also includes a second axial end portion having a second outer diameter greater than the first outer diameter. The first axial end portion is for engagement with an inner cylindrical surface of the valve seat and the second axial end portion is for engagement with an axial end surface of the valve seat to provide a sealing action at two spaced apart locations in the valve seat.

The bias means is a spring located within the cavity. A relatively hard member is located between the seal and spring for biasing the seal in a direction towards the seal seat surface of the valve body and towards the valve seat of the head. The seal is resiliently deformable and deforms to engage the inner cylindrical surface when subjected to force exerted by the spring squeezing the first axial end portion of the seal between the seal seat surface and member.

The seal seat surface is annular with an inner diameter equal to the outer diameter of an adjacent portion of the valve body. The seal seat surface has an outer diameter which is greater than the largest outer diameter of the valve body and smaller than the inner diameter of the valve seat. A valve guide is provided adjacent the chamber for receiving another portion of the valve body. The valve guide, chamber, valve seat, cavity and inlet are disposed in the head in a coaxial relationship. The outlet is disposed transversely to the axis of the coaxial arrangement.

A trigger is pivotable relative to the head for actuating the valve body to move towards the open position upon pivoting relative to the head. A second seal is receivable on the stem portion of the valve body in a seal chamber located within the valve guide. A tube extends into the container and a tube seal surrounds the siphon tube and engages the neck of the container and the head.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
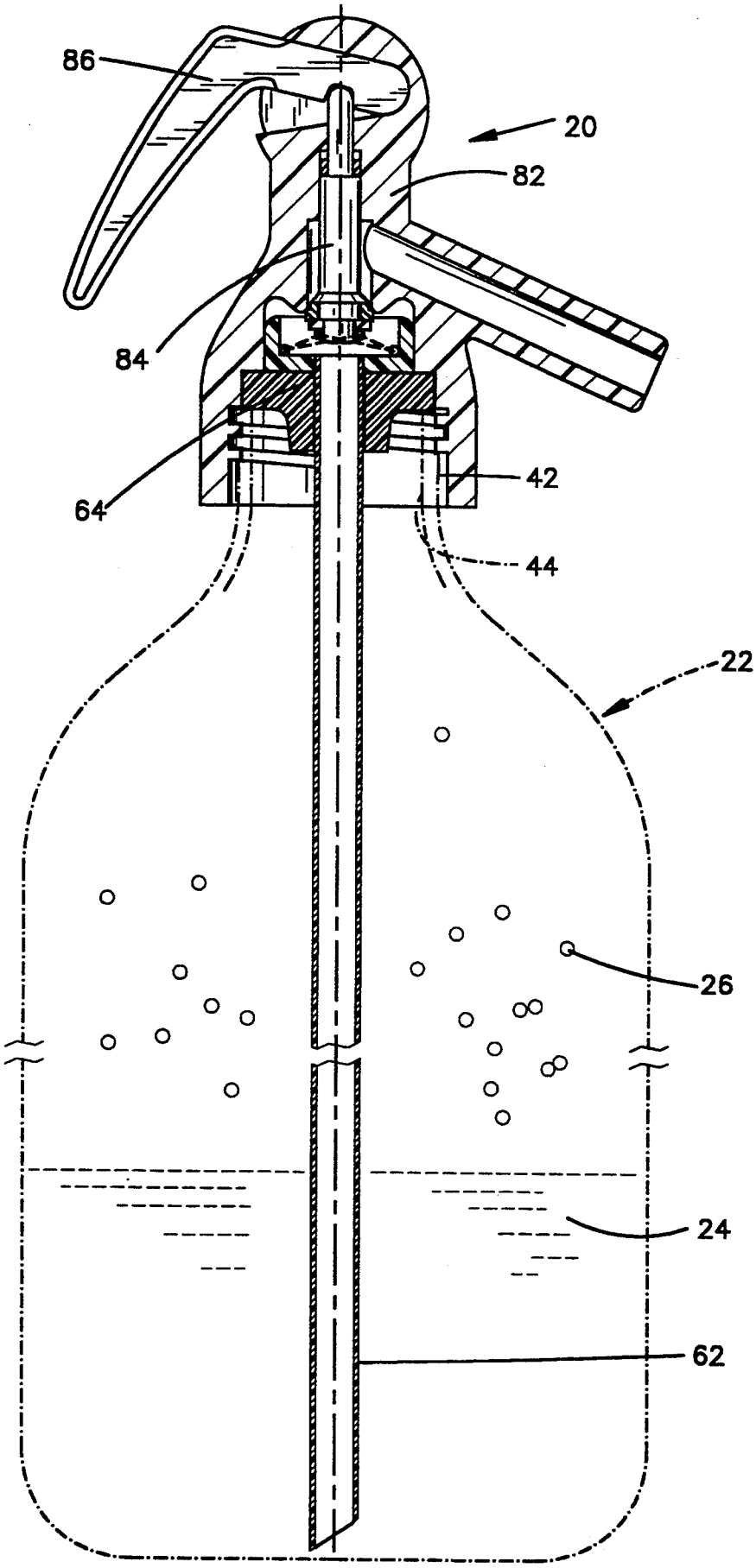
FIG. 1 is an overall cross-sectional view of the dispenser embodying the present invention connected with a container.

A dispenser 20 embodying the present invention is illustrated in FIG. 1, operably connected to a container 22. The container 22 may be of a resiliently deformable plastic material and contain a liquid beverage drink 24, such as a soda pop. The soda pop is made to include gaseous carbonation 26 that at least partially separates from the liquid beverage drink 24 and pressurizes the interior of the container 22 The gaseous carbonation 26 has a lower specific gravity than the liquid beverage drink 24, so the carbonation tends to fill the upper portion of the container 22 while the liquid beverage drink remains in a lower portion of the container.

The container 22 includes a neck 42 with a threaded exterior surface for receiving a bottle cap (not shown), as is known. The neck 42 includes an opening 44 for the liquid beverage drink 24 contained in the container 22 to exit the container through. A tube 62 is provided and sized to extend from adjacent the neck 42 to the bottom of the container, as viewed in FIG. 1. A tube seal 64 engages the axial end surface of the neck 42 of the container 22, when the neck 42 is properly threaded into the dispenser 20. The tube seal 64 prevents liquid and gas from escaping the container 22 at the interface of the dispenser 20 and the axial end surface of the neck 42. The tube seal 64 also supports the tube 62 near the center of the dispenser 20 and container 22.

The dispenser 20 (FIG. 2) includes a head 82 which is removably connectable with the container 22. The dispenser 20 also includes a valve body 84 which is actuatable to move between a closed position blocking fluid flow through the dispenser and an open position allowing fluid flow through the dispenser. A trigger handle 86 is pivotably received in the head 82. The trigger handle 86 actuates the valve 84 to move between the open and closed positions in response to pivotal movement relative to the head 82.

Figure 5:
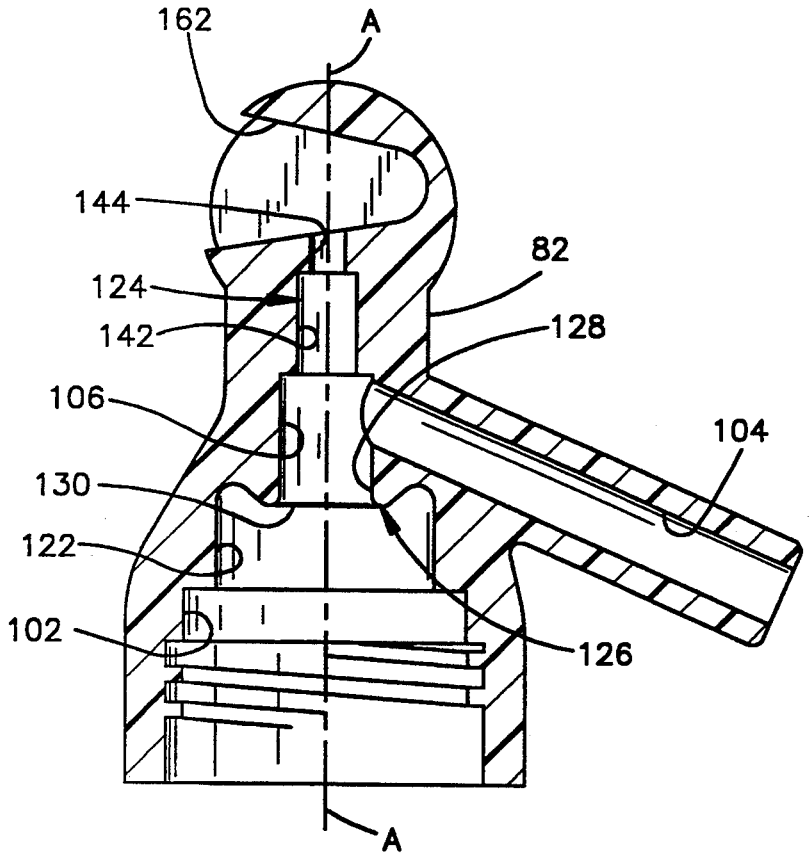
FIG. 5 is an enlarged cross-sectional view of a head of the dispenser illustrated in FIG. 1.

The head 82, best seen in FIG. 5, is preferably made as an integral one-piece injection molded plastic component. The head 82 includes an inlet 102 and an outlet 104. The inlet 102 has a threaded internal portion for threaded engagement with the threaded exterior surface of the neck 42 of the container 22. The tube seal 64 is sized to engage an inner cylindrical portion of the inlet 102, an axial end surface of the inlet and an axial end surface of the neck 42. The outlet 104 is used to direct a beverage being dispensed to a desired location, such as into a glass for serving. The head 82 includes a generally cylindrically shaped chamber 106 between the inlet 102 and outlet 104 for fluid communication therebetween.

The head 82 also includes a cavity 122 located between the inlet 102 and the chamber 106. A valve guide 124 is provided in the head 82 for receiving and supporting the valve body 84. A valve seat 126 is located at an opposite end of the chamber 106 relative to the valve guide 124 and between the cavity 122 and chamber. The inlet 102, cavity 122, valve seat 126, chamber 106 and valve guide 124 are preferably arranged in a coaxial relationship with one another in the head 82 along the axis A. The outlet 104 extends in a direction transversely of the axis A and of the coaxial relationship of the inlet 102, cavity 122, valve seat 126, chamber 106 and valve guide 124.

The valve guide 124 includes a first cylindrical portion 142 of a first diameter. The valve guide 124 also includes a second cylindrical portion 144 having a second diameter which is less than the first diameter of the first portion 142. The valve seat 126 includes an inner cylindrical surface portion 128. The valve seat 126 also includes an axial end surface 130 which is substantially planar. The inner cylindrical surface portion 128 is located adjacent to the axial end surface 130 of the valve seat 126 and extends in a direction transversely to the end surface.

A handle cavity 162 is formed at the upper end of the head 82, as viewed in FIG. 5, and is in communication with the second cylindrical portion 144 of the valve guide 124. The handle cavity 162 permits the trigger handle 86 to pivot relative to the head 82. Surfaces defining the handle cavity 162 prevent movement of the trigger handle 86 beyond pivot limits by contact therebetween. The trigger handle 86 and handle cavity 162 are shaped to cooperate with the valve body 84 to retain the trigger handle within the handle cavity and to permit the trigger handle to pivot relative to the head 82.

Figure 6:
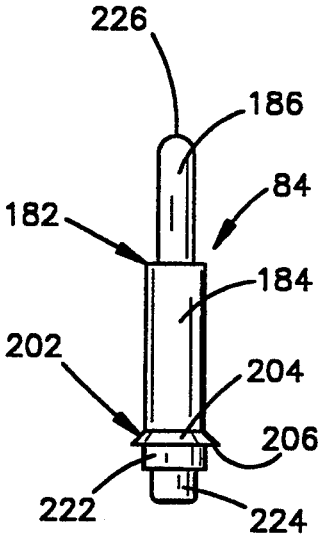
FIG. 6 is an enlarged view of a valve member of the dispenser illustrated in FIG. 1.

The valve body 84, best seen in FIG. 6, is receivable within the chamber 106 and valve guide 124 of the head 82. Upon actuation, the valve body 84 is movable in a direction along the axis A of the head 82 between the open and closed positions in order to control fluid flow through the chamber 106 and dispenser 20. The valve body 84 includes a stem portion 182 which is receivable in the chamber 106 and valve guide 124. The stem portion 182 includes a first stem portion 184 and a second stem portion 186.

The first stem portion 184 has a first diameter and is received at least partially in a close fitting relationship within the first portion 142 of the valve guide 124. The first stem portion 184 is also at least partially received in the chamber 106 with sufficient radial clearance between the surface defining the chamber and the first stem portion. The radial clearance permits a relatively large volume and flow of fluid between the surface of the chamber 106 and first stem portion 184. The second stem portion 186 has a second diameter which is less than the first diameter of the first stem portion 184. The second stem portion 186 of the valve body 84 is receivable in a close fitting relationship in the second portion 144 of the valve guide 124.

The valve body 84 (FIG. 6) includes a seal seat portion 202 preferably formed integrally with the valve body as a one-piece member of plastic by injection molding. The seal seat portion 202 includes a tapered surface 204 and an axial seal seat surface 206. The tapered surface 204 is adapted to face in a direction toward the valve guide 124, or upwardly as viewed in FIG. 2, when the valve body 84 is properly installed in the valve guide and chamber 106 of the head 82. The axial seal seat surface 206 is adapted to the face in a direction toward the inlet 102, or downwardly as viewed in FIG. 2, when the valve body 84 is properly installed within the valve guide 124 and chamber 106 of the head 82.

The axial seal seat surface 206 is annular with an innermost diameter equal to the outer diameter of an adjacent first portion 184 of the valve body 84. The axial seal seat surface 206 also has an outer diameter which is greater than the largest diameter of the valve body 84 and smaller than the inner diameter of the inner cylindrical portion 128 of the valve seat 126. The axial seal seat surface 206 provides a rigid planar surface for an axial end of seal 242 (FIG. 2) to engage and act as a stop surface to prevent axial movement of the seal 242 upwardly along the valve body 84, as viewed in FIG. 2. The valve body 84 (FIG. 6) includes a cylindrical portion 222 for receiving an inner surface of the seal 242 in a close fit relationship. Such a seal seat surface 206 and cylindrical portion 222 arrangement does not require the seal 242 to expand over a valve body part and then contract into a groove as in the prior art. Thus, there is ease of assembly and little or no possibility that the seal 242 stretches or deforms beyond its elastic limit during assembly and is better able to provide desirable sealing of gas and liquid for a relatively long service life in the dispenser 20.

The valve body 84 also includes a first axial end portion 224 adjacent the cylindrical portion 222 for receiving and guiding a member such as another seal, a spring and/or a washer. The outer diameter of the cylindrical portion 222 is greater than the outer diameter to the first axial end portion 224. A second axial end portion 226 of the valve body 84 is rounded to serve as a bearing surface for engaging a cavity 230 in the trigger handle 86. When the trigger handle 86 is pivoted downwardly relative to the head 82, as viewed in FIG. 2., the rounded second axial end portion 226 forces the valve body 84 to move downwardly along the axis A within the chamber 106 and valve guide 124 towards the open position. The second axial end portion 226 also prevents the trigger handle 86 from moving in a direction transversely to the axis A when the valve body 86 is properly installed in the head 82.

Figure 2:
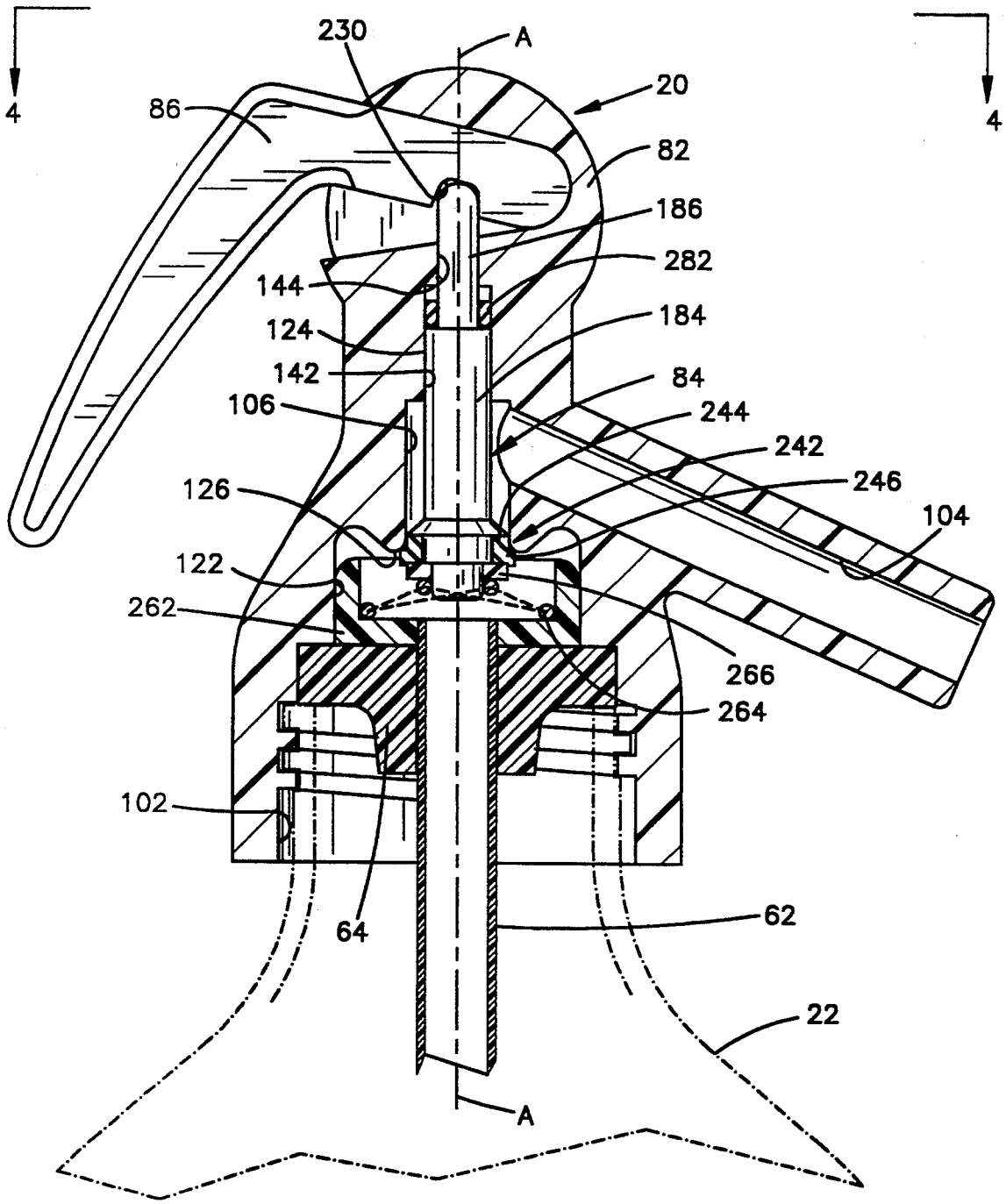
FIG. 2 is an enlarged cross-sectional view of the dispenser illustrated in FIG. 1.

As illustrated in FIG. 2, the valve body 84 is properly installed within the valve guide 124 and chamber 106. The seal 242 is tightly received around the cylindrical portion 222 and engages the axial seal seat surface 206 of the seal seat 202. The seal 242 is made from a resiliently deformable material that is preferably softer than the plastic material of the head 82 or valve body 84 to conform to any surface irregularities in the head or valve body and to expand against the inner cylindrical surface portion 128 when biased by the spring 264. The axial seal seat surface 206 assures that the seal 242 will not move relative to the valve body 84 when the dispenser 20 is properly assembled and serves to block fluid flow between the interface of the seal and valve body.

The seal 242 also engages the valve seat 126 to a establish the closed position of the valve body 84 relative to the head 82 and block fluid flow from the inlet 102 to the chamber 106. The closed position of the valve body 84 relative to the head 82 prevents any beverage from being dispensed through the outlet 104. Gas pressurization or carbonation 26 within the bottle 22 tends to bias or move the seal 242 in a direction along the axis A, upwardly as viewed in FIG. 2, against the valve seat 126 and seal seat surface 206.

The seal 242 (FIG. 2) includes a first axial end portion 244 having a first outer diameter and an axial end surface which engages the axial seal seat surface 206. The seal 242 also includes a second axial end portion 246 having a second outer diameter greater than the first outer diameter of the first axial end portion 244. The first axial end portion 244 of the seal 242 is adapted to engage, and the first outer diameter is sized for close fitting engagement with, the inner cylindrical surface portion 128 (FIG. 5) of the valve seat 126. The second axial end portion 246 of the seal 242 has an annular axial end surface that is adapted to engage the axial end surface 130 (FIG. 5) of the valve seat 126. This dual sealing arrangement at spaced apart locations in the valve seat 126, assures that positive sealing and blocking of fluid flow occurs at the seal 242 and valve seat 126 interface without any part of the valve body 84 directly acting as a seal against the head 82. Since the seal 242 is made from a resiliently deformable and relatively soft elastomeric material, any wear of the seal, valve body 84 or valve seat 126 can be compensated by deformation of the seal. This dual seal arrangement provides sealing for a relatively long period of time to assure that carbonation loss is minimized or eliminated. The positive dual seal arrangement also provides a long lasting service life the dispenser 20. Testing of the dispenser 20 has resulted in a carbonated beverage not becoming "flat" for thirty five days.

Downwardly of the valve body 84, as viewed in FIG. 2, an end cap 262 is received within the cavity 122 of the head 82 in close fitting engagement with the surface defining the cavity. The close fitting engagement can be accomplished by any suitable securement method, such as by press fitting or adhesive bonding. A spring 264 is located within the end cap 262 and engages a member 266, such as a washer or another seal which is located on the axial end portion 224 of the valve member 84. The member 266 preferably is formed from a material harder than the seal 242 to help force the seal against the seal seat surface 206. The spring 264 exerts a force tending to lengthen or expand along the axis A. Because of the engagement of the spring 264 with the end cap 262 and member 266, the spring urges the valve body 84 and seal 242 upwardly against the valve seat 126 towards the closed position to block fluid flow from the inlet 102 to the chamber 106.

When the valve body 84 cannot move any further upwardly, as viewed in FIG. 2, because the trigger handle 86 engages the upper surface of the cavity 162 the spring 264 still exerts a biasing force. This biasing force serves to even better force the seal 242 against the valve seat 126. Specifically, the spring 264 exerts a force on the member 266. The member 266 transmits the force to the seal 242 until the member engages the axial end surface of the cylindrical portion 222 of the valve body 84.

The valve body 84 and the seal seat surface 206 cannot be moved any further upwardly, as viewed in FIG. 2, by the biasing force of the spring 264 acting against member 266. The biasing force of the spring 264 is used to resiliently deform the seal 242 radially against, the valve body and valve seat 126. That is, the seal 242 has axial forces acting on it. The seal 242 is essentially axially squeezed between the member 266 and seal seat surface 206. Since the seal 242 is made from a resiliently deformable elastomeric material and because of its shape it tends to expand radially inwardly against the cylindrical portion 222 of the valve body 84 and radially outwardly against the inner cylindrical surface 128 of the valve seat 126 with an increased sealing action.

Another seal 282 is received on the valve stem portion 186 of the valve body 84, as illustrated in FIG. 2, and located within the first portion 142 of the valve guide 126. The seal 282 assures that little or no pressurized fluid flow exits the dispenser 20 from between the valve guide portion 144 and valve stem portion 186.

This assures that all of the fluid exits through the outlet 104 in the head 82 of the dispenser 20.

Figure 3:
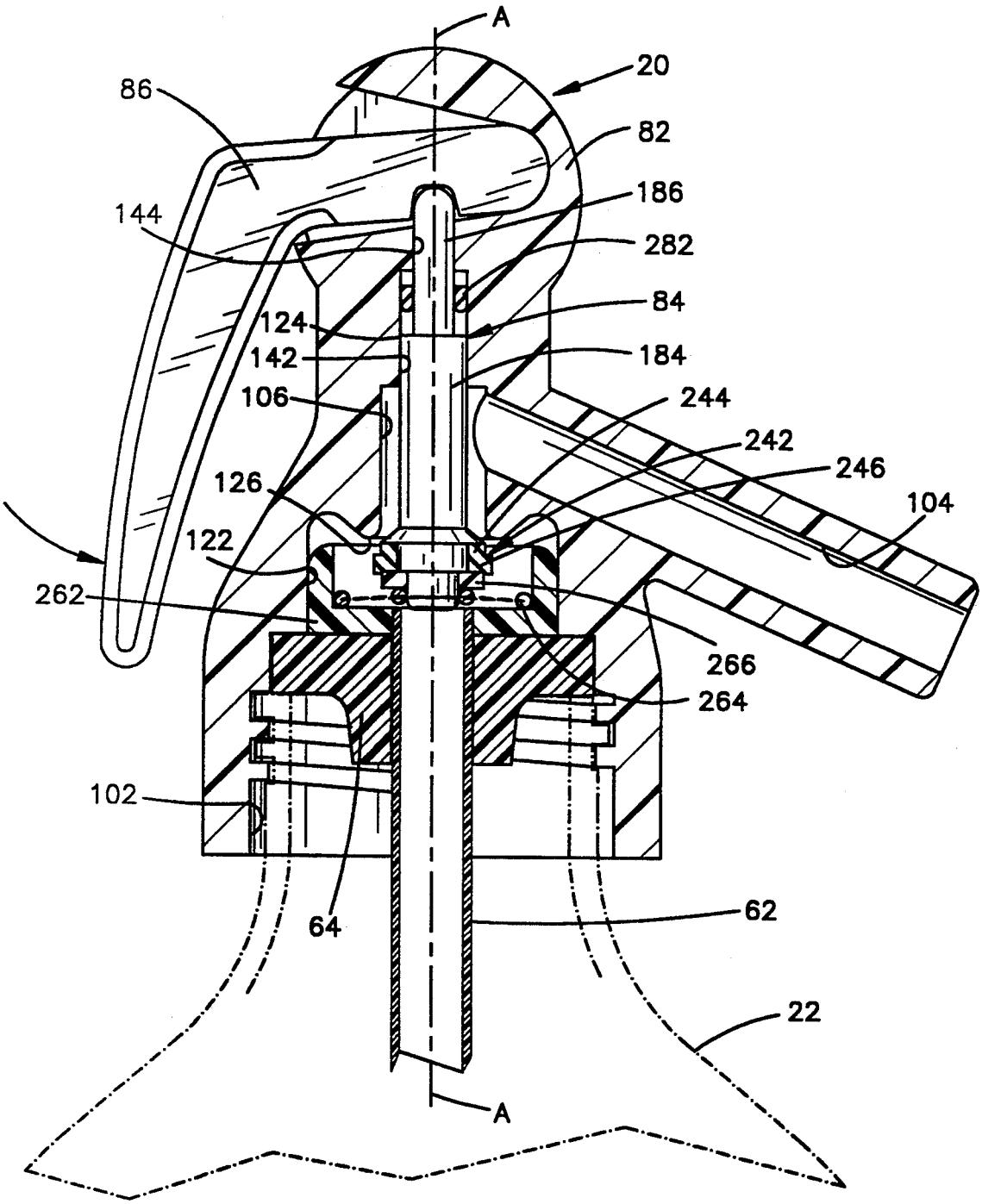
FIG. 3 is a view similar to FIG. 2, with some of the parts illustrated in different positions.
Figure 4:
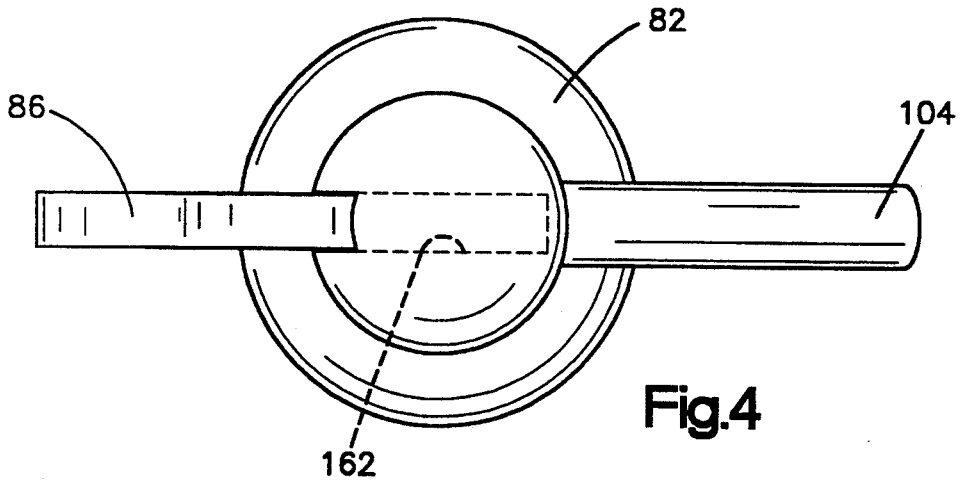
FIG. 4 is a top view of the dispenser illustrated in FIG. 1, taken approximately along the line 4—4 in FIG. 2.

FIG. 3 illustrates the trigger handle 86 pivoted downwardly relative to the head 82. The trigger handle 86 forces the valve body 84 downwardly relative to the head 82 along the axis A to the open position. The spring 266 compresses and the seal 242 is moved away from the valve seat 126 to permit fluid to flow through the tube 62, past the inlet 102 and tube seal 64 into the cavity 122, between the valve seat 126 and seal 242, into the chamber 106 and through the outlet 104. When a container, such as a glass (not shown), has been filled to a desired level with the beverage, an operator of the dispenser 20 then releases the trigger handle 86. The valve body 84 is returned to the closed position by the spring 266, as illustrated in FIG. 2, to block fluid flow into the chamber 106 because the seal 242 is now engaged again with the valve seat 126. Concurrently with the movement of the valve body 84, the trigger handle 86 pivots relative to the head 82, to the position illustrated in FIG. 2.

From the above description of a preferred embodiment of the invention, those skilled in the art will preserve improvements, changes and modifications. Such improvements, changes and modifications within the skill of art are intended to be covered by the appended claims.

Having described a preferred embodiment of the invention, what is claimed is:

1. A dispenser for use with a pressurizable fluid container, said dispenser comprising:

a head removably connectable with the container and including an inlet, an outlet, a valve seat, a cavity and a chamber for fluid communication between said inlet and outlet, said valve seat located between said inlet and said chamber, said cavity located between said inlet and said valve seat;

a valve body having a portion receivable in said chamber, said valve body being actuatable for movement between an open position allowing fluid flow through said chamber and a closed position blocking fluid flow through said chamber, said valve body including a seal seat surface adapted to face in a direction towards said inlet;

a seal receivable on said valve body for engagement with said seal seat surface, said seal being engageable with said valve seat to establish the closed position;

a cap member receivable within said cavity; and bias means engageable with said cap member for normally biasing said seal towards said valve seat.

2. The dispenser set forth in claim 1 wherein said seal further includes a first axial end portion having a first outer diameter and a second axial end portion having a second outer diameter greater than the first outer diameter, said first axial end portion for engagement with an inner cylindrical surface portion of said valve seat and said second axial end portion for engagement with an axial end surface of said valve seat.

3. The dispenser set forth in claim 1 wherein said seal seat surface on said valve body is annular with an inner diameter equal to the outer diameter of an adjacent portion of said valve body and an outer diameter greater than the largest outer diameter of said valve body and smaller than the inner diameter of said valve seat.

4. The dispenser set forth in claim 1 wherein said bias means comprises a spring and further including a member located between said seal and said spring for biasing said seal in a direction towards said valve seat.

5. The dispenser set forth in claim 1 further including a valve guide for receiving another portion of said valve body.

6. The dispenser set forth in claim 5 wherein said valve guide and said chamber are disposed in a coaxial relationship.

7. The dispenser set forth in claim 1 wherein said inlet, cavity and chamber are disposed in a coaxial relationship.

8. The dispenser set forth in claim 7 wherein said outlet passage is disposed transversely to the axis of the coaxial arrangement between said chamber, cavity and inlet.

9. The dispenser set forth in claim 1 further including a trigger pivotable relative to said head for actuating said valve body to move towards the open position upon pivoting relative to said head.

10. The dispenser set forth in claim 1 further including a tube extendable into the container and a tube seal for surrounding a portion of said tube and engageable with a neck of the container and said head.

11. The dispenser set forth in claim 6 further including a second seal receivable on said stem portion of said valve body, said second seal being located between said chamber and said valve guide.

12. A dispenser for use with a pressurizable fluid container, said dispenser comprising:

a head removably connectable with the fluid container and including an inlet, an outlet, a valve seat and a chamber for fluid communication between said inlet and outlet;

a valve body having a portion receivable in said chamber, said valve body being actuatable for movement between an open position allowing fluid flow through said chamber and a closed position blocking fluid flow through said chamber;

a seal receivable on said valve body, said seal includes a first seal portion for engagement with a first portion of said valve seat and a second seal portion for engagement with a second portion of said valve seat to establish the closed position;

bias means for biasing said seal towards the closed position; and an annular seal seat surface on said valve body located between axially opposite ends of said valve body and having an outer diameter greater than the outer diameter of said valve body, said annular seal seat surface adapted to face in a direction towards said inlet for engagement with said seal.

13. The dispenser set forth in claim 12 wherein said first seal portion has a first outer diameter and said second seal portion has a second outer diameter greater than the first outer diameter, said first seal portion for engagement with an inner cylindrical surface portion of said valve seat and said second seal portion for engagement with an axial end surface of said valve seat.

14. The dispenser set forth in claim 12 wherein said first and second portions of said valve seat are spaced apart in a direction along said valve body.

15. An improved fluid flow control apparatus including a valve seat through which fluid may flow and having a first seat portion and a second seat portion, the improvement comprising a seal having a first seal portion for engaging the first seat portion of the valve seat and a second seal portion for engaging the second seat portion of the valve seat spaced from said first seat portion, said seal being movable between an open position in which said seal is unengaged from the valve seat to permit fluid flow though the valve seat and a closed position in which said first and second seal portions engage the respective first and second seat portions of the valve seat to block fluid flow through the valve seat, said first seal portion is cylindrical and has a first outer diameter, said second seal portion is cylindrical and has a second outer diameter greater than the first outer diameter, said first seal portion for engagement with an inner cylindrical surface portion of the valve seat and said second seal portion for engagement with an axial end surface of the valve seat.

16. The improvement set forth in claim 15 further including bias means for biasing said seal in a direction towards the valve seat.

17. The improvement set forth in claim 16 further including a member located between said bias means and said seal, said member being made from a material harder than said seal.

18. The improvement set forth in claim 17 wherein said seal is made from a material which is resiliently deformable and deforms in a direction transversely to the direction of a force being applied to said seal by said bias means.

* * * * *